United States Patent [19]

Shaw

[11] 4,419,970

[45] Dec. 13, 1983

[54] CYLINDER BLOCK

[75] Inventor: Terrence M. Shaw, Columbus, Ind.

[73] Assignee: Cummins Engine Company, Inc., Columbus, Ind.

[21] Appl. No.: 347,188

[22] Filed: Feb. 9, 1982

Related U.S. Application Data

[63] Continuation of Ser. No. 104,096, Dec. 17, 1979, abandoned.

[51] Int. Cl.[3] ..... F02F 1/36

[52] U.S. Cl. ..... 123/41.74; 123/193 C

[58] Field of Search ..... 123/41.72, 41.74, 41.83, 123/41.81, 193 R, 193 C, 193 CH, 193 CP

[56] References Cited

U.S. PATENT DOCUMENTS

| | | | |
|---|---|---|---|
| 1,968,110 | 7/1934 | Walker | 123/41.72 |
| 2,685,282 | 8/1954 | Seitz | 123/41.74 |
| 2,985,148 | 5/1981 | Caris | 123/193 R |
| 3,942,487 | 3/1976 | Zink | 123/41.74 |
| 4,066,057 | 1/1978 | Hale | 123/41.72 |
| 4,175,503 | 11/1979 | Ernest | 123/193 CH |

FOREIGN PATENT DOCUMENTS

| | | |
|---|---|---|
| 147010 | 4/1921 | United Kingdom . |
| 310146 | 4/1929 | United Kingdom . |
| 336663 | 10/1930 | United Kingdom . |

*Primary Examiner*—Craig R. Feinberg

*Attorney, Agent, or Firm*—Neuman, Williams, Anderson & Olson

[57] ABSTRACT

A cylinder block for an internal combustion engine is provided which includes a cooling jacket having a peripheral wall forming the exterior of the block and a plurality of cylinder tubes disposed within and encompassed by said wall. A plurality of depending openings or bores are formed in the top surface of the block to accommodate a corresponding number of bolts for assembling a cylinder head on the block top surface. Each opening is internally threaded; however, the threads within the openings commence at different levels relative to the block top surface. The level at which the threads commence will depend upon the location of the opening with respect to the cooling jacket peripheral wall. Thus, the greater the distance the opening is from the wall, the threads thereof will commence within the opening at a greater depth from the top surface of the block.

6 Claims, 4 Drawing Figures

FIG. 1
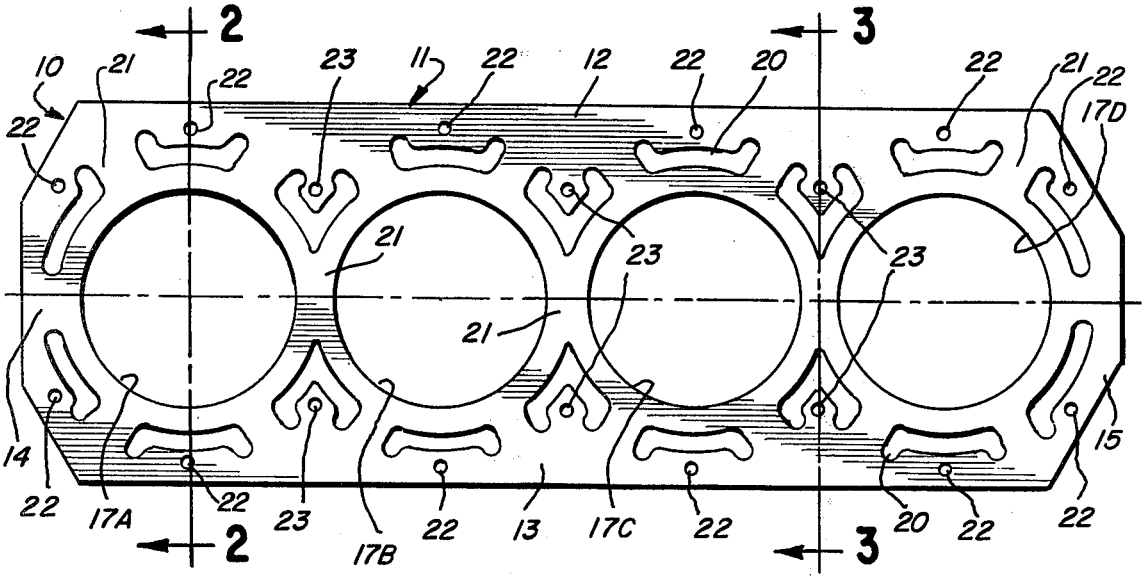
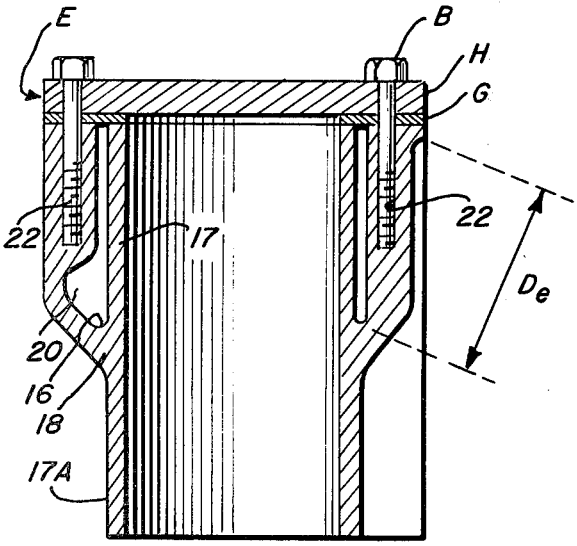
FIG. 2
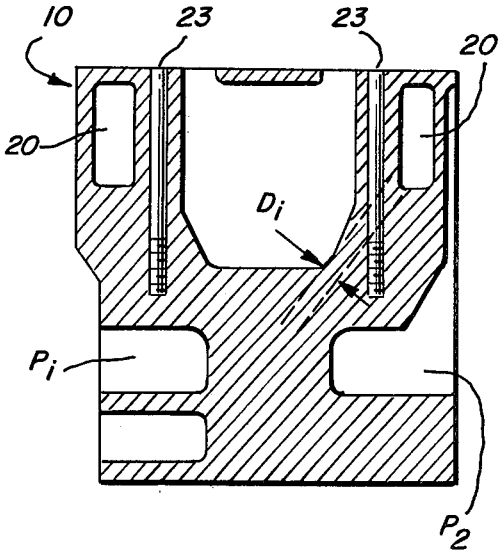
FIG. 3

CYLINDER BLOCK

This is a continuation of application Ser. No. 104,096 filed Dec. 17, 1979 now abandoned.

BACKGROUND OF THE INVENTION

In a typical internal combustion engine cylinder block, the cooling jacket thereof is formed by interconnected side and end walls of the block coacting with a floor section. Cylinder tubes are formed within the block and extend, at least in part, upwardly into the jacket. A conventional piston assembly, including a piston head, piston rings, and a liner or core, is normally disposed within each cylinder tube. A cylinder head is compressed against the top surface of the block with a head gasket sandwiched therebetween, thereby forming a sealed coolant cavity around the cylinder tubes so that a liquid, such as water, may freely circulate with minimum obstruction and thus effectively remove excess heat from the tube walls via an external heat exchanger. Maintaining a freely flowing coolant around a substantial exterior portion of the cylinder tube is necessary and desirable for continuous and efficient engine operation. An individual combustion chamber is provided for each cylinder and is defined by the upper portion of the cylinder tube, or liner, the cylinder head and gasket overlying same, and the reciprocating piston head when the latter is at and near its top dead center position within the tube.

Normally, the cylinder tubes are free standing and independent of the surrounding block structure except for the floor section to which they are connected. Such a block is typically cast as a single piece. The free standing arrangement of the cylinder tubes maximizes cooling thereof, while at the same time a relatively high cylinder tube compliance results. With this arrangement, however, when the engine is assembled, the cylinder head is usually secured by a plurality of head bolts to the top of the block, causing a substantial axial compression to be exerted on the cylinder tubes engaged thereby. The head bolts are generally of uniform length and engage internally threaded openings, or bores, formed in the cooling jacket walls and in bosses disposed inwardly of such walls. The threads of each opening in the conventional block design normally commence at the same level relative to the top surface of the cylinder block. The jacket walls provide some axial support to those portions of the cylinder tubes proximate thereto, but as to the portions of cylinder tubes more distant from the jacket walls, there is little or no axial support by the latter. This nonuniform support results in relatively large axial and radial variations around the periphery of the tubes, thereby promoting substantial distortions thereof when the engine is assembled. These distortions shorten seal life, degrade seal efficiency, cause uneven combustion seal load distribution, promote uneven cylinder and piston ring wear, and in some instances may even cause engine failure resulting in a major overhaul.

SUMMARY OF THE INVENTION

It has been determined that the support of any point on the top surface of a cylinder tube and the resulting compliance of the cylinder tube are proportional to (a) the amount of material forming the cylinder tube and support therefor and (b) the distance between the bottom of the block forming the cooling jacket floor section and where the shank of each cylinder head bolt threadably engages the internal threads of the corresponding bore formed in the block. While the amount of material may be significantly increased to provide additional support, this nonetheless contributes to excessive weight, may obstruct a critical coolant flow path, and may alter the thermodynamics of the engine's operation.

It is an object of the invention to provide an improved cylinder block construction which effectively overcomes the problems associated with prior structures of this general type.

It is a further object of the present invention to provide an improved cylinder block wherein variations in cylinder tube distortions resulting from assembly of the cylinder head to the engine block are minimized.

It is a further object of the invention to provide a cylinder block construction wherein the useful life of the cylinder head seal is significantly prolonged.

Further and additional objects will become apparent from the description, accompanying drawings, and appended claims.

In accordance with one embodiment of the invention, a cylinder block for an internal combustion engine is provided which includes a cooling jacket having the wall thereof encompassing a plurality of cylinder tubes extending upwardly from the floor section of the jacket and having the upper ends of the tubes generally coplanar with the upper edges of the cooling jacket wall and defining the top surface of the block. A plurality of depending threaded bores are provided in the block to accommodate a corresponding number of bolts utilized to secure a cylinder head and head gasket to the top surface of the block. A first set of bores is disposed adjacent the cooling jacket wall and a second set of bores is formed in bosses spaced inwardly from the wall and in close proximity to the exterior of the cylinder tubes. Each of the bores is internally threaded to receive the shank of a corresponding head bolt; however, the threads in each of the first set of bores (that is, those bores closest to the jacket wall) commence at a level which is closer to the top surface of the block than the commencement of the internal threads formed in the second set of bores. Thus, the further a bore is located from the jacket wall, the greater the distance from the block top surface will the internal threads commence within the bore.

BRIEF DESCRIPTION OF THE DRAWINGS

FIG. 1 is a top plan view of an improved cylinder block having a cooling jacket and cylinder tubes configured in accordance with one embodiment of the present invention.

FIG. 2 is a cross-sectional view taken along the line 2—2 of FIG. 1 and showing a gasket, cylinder head, and head bolts assembled on the block top surface.

FIG. 3 is a cross-sectional view taken along the line 3—3 of FIG. 1.

DESCRIPTION

Figure 4:
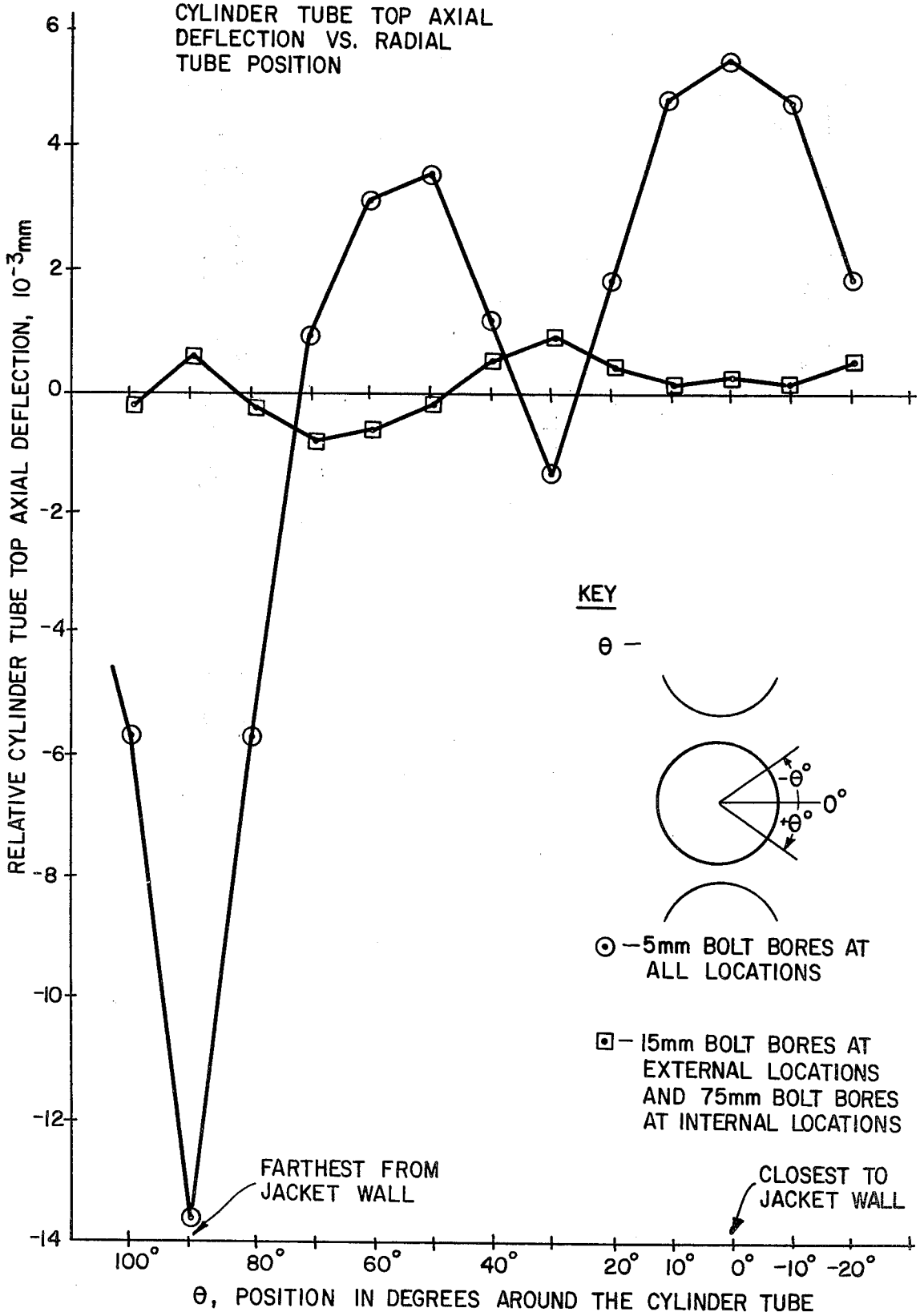
FIG. 4 is a graph comparing the relative axial deflection of areas of the top surface of a cylinder tube as determined by the threaded bores adjacent thereto, and the relative locations of such bores to the axis of the tube in a conventional cylinder block to that in the improved cylinder block.

Referring now to FIGS. 1–3, one form of the improved cylinder block 10 is shown which is adapted for use in a four cylinder, high-compression, internal combustion engine E. The block is normally a one-piece metal casting and includes a cooling jacket 11 defined by side walls 12, 13, end walls 14, 15, and a floor section 16. A plurality of cylinder tubes 17 are disposed within the jacket 11 and extend upwardly from and are joined at 18 to the floor section 16. The upper ends of the tubes 17 are generally coplanar with each other and the upper edges of the jacket walls, thereby defining the top surface of the cylinder block 10. It is to be understood of course that the cooling jacket may have a variety of shapes and in some instances the upper ends of the cylinder tubes may not be coplanar with each other or the upper edges of the jacket walls.

Referring to FIG. 2, a segment of the internal combustion engine E is shown which includes a conventional sealing gasket G disposed on and coincident with the top surface of the block 10, a cylinder head H overlying the gasket G, and a plurality of conventional cylinder head bolts B tightly securing the head H and gasket G to the top surface of the block 10. The concealed surface of the head H coacts with the jacket walls and tubes 17 to form a coolant flow space 20 which surrounds the exterior of the cylinder tubes.

For purposes of facilitating understanding the instant invention, the cylinder block 10 hereinafter described will include four cylinder tubes 17A, B, C and D arranged in spaced, in-line relation. The number, size and arrangement of the tubes may vary from that shown and will depend upon the operating requirements of the internal combustion engine. As aforementioned, block 10 is cast of metal, such as iron, with the jacket 11 and tubes 17A–D forming an integral unit. Thin radial supports or webs 21 are also cast in the block and connect the tops of the cylinder tubes 17 to an adjacent portion of the cooling jacket 11 and to an adjacent cylinder tube, see FIG. 1. The webs offer minimal axial support to the tube. Accordingly, the only significant axial support for the cylinder tubes is provided by the jacket floor section 16. As previously indicated, some engine blocks may utilize additional cylinder tube support, such as large diameter radial webs or a thickened jacket floor section, but such structures result in excess weight, alteration of thermodynamic properties of the block, and irregular cylinder tube compliance. The number and location of the webs are optional and in some instances the webs may be omitted without affecting the present invention.

The space or cavity 20 formed between the cylinder tubes 17 and the walls of the cooling jacket 11 is preferably continuous from one end of the block to the other; however, this arrangement may be varied, if desired. A liquid coolant normally circulates through the cavity and transfers excess heat to an external heat exchanger, not shown. Circulation of the coolant is provided by a pump, not shown.

A plurality of internally threaded head bolt openings or bores 22 are usually located in spaced relation on the upper or top surface of the block adjacent the cooling jacket walls 12–15.

As seen in FIGS. 1–3, there are four bores 22 located in a semi-encompassing relation as to each of the cylinder tubes 17A and D disposed at opposite ends of the block. Two of the peripheral bores 22 are disposed in substantially diametrically opposed relation with respect to each of the cylinder tubes 17B–C located between the end tubes 17A and D. The peripheral bores 22 are shown integrally cast within the block; however, if desired, they may be drilled into and/or through the block.

Additional internally threaded bores 23 are formed in bosses provided in the block, and such bores are disposed inwardly from the peripheral bores 22. The bores 23 are spaced generally circumferentially with respect to tubes 17B–C and are a substantial distance from the side walls 12–13 forming the cooling jacket 11. As noted in FIG. 2 and 3, the depth of bore 22 is substantially less than the depth of bore 23. Where the bores 23 extend through a portion of the block, the threaded end of the bolt B disposed therein may be engaged by a nut, not shown, located in either pocket $P_1$ or $P_2$ formed in the block.

As set forth earlier, those portions of the cylinder tubes proximate the jacket walls benefit from additional axial support when the cylinder head is bolted in place, resulting in a relatively low cylinder tube compliance. But in cylinder blocks typical of the prior art where all head bolt bores are threaded to a uniform depth, those portions of the cylinder tubes more distant from the jacket walls, such as between cylinder tubes, there is little or no axial support, resulting in a relatively high cylinder tube compliance. These variations in compliance are graphically illustrated in FIG. 4.

FIG. 4 is a comparison graph of the relative cylinder tube top axial deflection versus the position, in degrees, around the cylinder tube. Theta ($\theta$) is measured in degrees from a zero position closest to a jacket wall and progresses around the top of a cylinder tube to 90°, closest to an adjacent tube and farthest from a jacket wall (see the abscissa of the graph). The relative axial deflection is measured at, or very near, the top of the cylinder tube (see the ordinate of the graph). The circled data points represent a prior art cylinder block design where the internal threading within the bores thereof commences uniformly at a depth of 5 mm and clearly illustrates the wide range of undesirable axial tube deflection as one progresses around the top of the tube.

The present invention minimizes these variations in deflection by varying the depths where the internal threading commences within the bores. By lowering the commencement of the internal threading within a bore relative to the top surface of the block 10 and, thus, the threaded engagement between the bolt shank and bore, the span of block material between the bottom or floor section of the cooling jacket and the bolt-bore engagement is reduced with a resulting reduction in the compliance of the region. Compare the distance $D_e$ in FIG. 2 to the distance $D_i$ in FIG. 3. At some optimum depth, depending in part upon the distance the bore is from the jacket wall, the tube compliance near the bores will be approximately the same, resulting in more uniform deflection at the top of the cylinder tube. This will also provide a more uniform combustion seal load distribution. The head bolt thread engagement may be at a point above the jacket floor section but below the top of the cylinder block by building up bosses from the jacket floor section.

Referring again to FIG. 4, the square data points represent an improved cylinder block design wherein the internal threading of the bores 22 commences at a depth of 15 mm, and as to the bores 23 the threading commences at a depth of 75 mm. The extremely minor variations in deflection around the top of the cylinder tube make the improvements over the prior art readily apparent. It has been found for optimum results that the depths at which the internal threading commences within the bores 22 should be in the range of from about 10 mm to about 20 mm and that the internal threading in the bores 23 should commence at depths of from about 60 mm to about 75 mm, for a bore of about 100 mm.

While a specific embodiment has been illustrated and described, it is to be understood that the depths, number, and location of the threaded bolt openings may vary as the number of cylinder tubes or other design requirements necessitate. Accordingly, variations, modifications, and the substitution of equivalent mechanisms can be effected within the scope of this invention.

What is claimed is:

1. A cylinder block for an internal combustion engine comprising a cooling jacket portion having walls and a floor section; a plurality of cylinder tubes of generally uniform thickness integral with said cooling jacket floor section and arranged in relatively spaced relation and extending at least in part upwardly into said cooling jacket from said floor section and below said floor section, each of said cylinder tubes substantially axially supported only by said jacket floor section and substantially isolated from each other tube and said cylinder block, upper ends of said tubes being generally coplanar with top edges of said cooling jacket walls and defining a top surface of the block; a plurality of first and second bores disposed within said cylinder block parallel to said cylinder tubes and adjacent a perimeter of and in outwardly spaced relation therefrom so that said cylinder tubes are isolated from said bores via the cooling jacket extending to the top surface of the block in regions located between said bores and said cylinder tubes, with said cylinder tubes being substantially entirely surrounded by coolant above said floor section, said bores being internally threaded within said block to threadably engage a corresponding number of cylinder head bolts; said first bores being in closer proximity to said jacket walls than said second bores, the internal threading of said second bores commencing at a level which is a greater distance from the top surface of said block than the level of commencement of the internal threading in said first bores, such that relative variations in axial cylinder tube deflection with respect to radial tube position that result from axial cylinder tube compression are minimized without any cylinder tube support other than that provided by said integral jacket floor section.

2. A cylinder block as in claim 1 wherein the depth of said first bores is less than the depth of said second bores.

3. A cylinder block as in claim 1 wherein the second bores are formed in a plurality of upwardly extending bosses disposed within said jacket and substantially between a pair of cylinder tubes, said bosses being isolated from said cylinder tubes.

4. A cylinder block as in claim 1 wherein the level of commencement of the internal threading of said first bores is about ten to about twenty millimeters below the top surface of said block.

5. A cylinder block as in claim 1 wherein the level of commencement of the internal threading of said second bores is about sixty to about seventy-five millimeters below the top surface of said block.

6. A cylinder block as in claim 1 wherein said first and second bores are generally equally radially spaced around said cylinder tube.

* * * * *